United States Patent [19]

Lelental et al.

[11] 4,410,614

[45] Oct. 18, 1983

[54] POLYMERIC ELECTRICALLY ACTIVE CONDUCTIVE LAYER (EAC) FOR ELECTRICALLY ACTIVATABLE RECORDING ELEMENT AND PROCESS

[75] Inventors: Mark Lelental; James M. Pearson, both of Rochester, N.Y.

[73] Assignee: Eastman Kodak Company, Rochester, N.Y.

[21] Appl. No.: 388,376

[22] Filed: Jun. 14, 1982

[51] Int. Cl.[3] ..... G03G 13/22; G03G 17/00

[52] U.S. Cl. ..... 430/45; 430/46; 430/48; 430/52; 430/56; 430/60; 430/62; 430/66; 346/153.1; 346/157; 346/76 R; 8/444

[58] Field of Search ..... 430/45, 46, 48, 52, 430/56, 60, 62, 66; 346/153.1, 157, 76; 8/444

[56] References Cited

U.S. PATENT DOCUMENTS

| | | | |
|---|---|---|---|
| 4,123,274 | 10/1978 | Knight et al. . | |
| 4,128,557 | 12/1978 | Knight et al. | 260/299 |
| 4,155,760 | 5/1979 | Lelental et al. | 430/56 X |
| 4,234,670 | 11/1980 | Kaukeinen et al. | 430/52 |
| 4,309,497 | 1/1982 | Lelental et al. | 430/80 |
| 4,332,875 | 6/1982 | Lelental et al. | 430/60 X |
| 4,374,916 | 2/1983 | Lelental et al. | 430/62 X |

FOREIGN PATENT DOCUMENTS 2018453 10/1979 United Kingdom .

OTHER PUBLICATIONS

Res. Dis. Oct., 1979, Item Nos. 18627, 18654.
Res. Dis. Dec., 1978, Item No. 17643.
Res. Dis., Nov. 1980, Item No. 19926.

*Primary Examiner*—Roland E. Martin, Jr.
*Attorney, Agent, or Firm*—Richard E. Knapp

[57] ABSTRACT

In an electrically activatable recording element and process comprising a polymeric electrically active conductive layer improvements are provided wherein the polymeric electrically active conductive layer comprises a polymer that has recurring units represented by the structure:

wherein

R is hydrogen or alkyl containing 1 to 20 carbon atoms;

$R^1$ and $R^3$ are individually hydrogen or methyl;

$R^2$ is alkyl containing 2 to 20 carbon atoms;

x is 0 or 1;

y is 0 to 4;

$R^4$ is $C_6H_{5-z}X_z$; wherein z is 1 to 5;

X is chlorine, bromine or iodine;

n is 40 to 100 weight percent;

and the polymer has a glass transition temperature within the range of 20° C. to 40° C.

Such a polymeric electrically active conductive layer is useful in, for example, an electrically activatable recording element comprising an electrically conductive support having thereon, in sequence:

(a) a polymeric electrically active conductive layer, as described, (b) an electrically activatable recording layer comprising:

(A) a dye-forming coupler, and (B) an oxidation-reduction combination comprising:

(i) an organic silver salt oxidizing agent consisting essentially of a silver salt of a 1,2,4-mercaptotriazole derivative with (ii) a reducing agent which, in its oxidized form, forms a dye with said dye-forming coupler, (c) a photoconductive layer separated from (b) by an air gap of up to 20 microns or separated from (b) by an electrically conductive interlayer, and (d) an electrically conductive layer.

The recording element is light handleable and provides a dye image and silver image by dry development processing.

36 Claims, 5 Drawing Figures

LATENT IMAGE FORMATION

HEAT DEVELOPMENT

LATENT IMAGE FORMATION

POLYMERIC ELECTRICALLY ACTIVE CONDUCTIVE LAYER (EAC) FOR ELECTRICALLY ACTIVATABLE RECORDING ELEMENT AND PROCESS

BACKGROUND OF THE INVENTION

1. Field of the Invention

This invention relates to a dye-forming electrically activatable recording element and process. One aspect of the invention relates to the use of a certain polyvinyl ester in the electrically active conductive layer, referred to herein as a polymeric EAC layer, in an electrically activatable recording element which is capable of producing a dye image and silver image by dry development processes.

2. Description of the State of the Art

Production of a dye image and silver image in an electrically activatable recording material by dry development techniques is described in *Research Disclosure,* October, 1979, Item No. 18627. In accord with that description, production of a dye image and silver image is accomplished by means of an electrically activatable recording element comprising an electrically conductive support, such as a poly(ethylene terephthalate) film with a cermet coating, having thereon, in sequence:

(a) an electrically activated recording layer comprising an organic silver salt and a reducing agent, (b) a photoconductive layer separated from (a) by an air gap of up to 20 microns, and (c) an electrically conductive layer on (b), wherein the recording layer comprises, in reactive association, (A) a dye-forming coupler, and (B) an oxidation-reduction combination comprising:

(i) an organic silver salt oxidizing agent, with (ii) a reducing agent which, in its oxidized form, forms a dye with the dye-forming coupler.

Such an electrically activated recording element enables formation of a dye image and silver image by heat processing after imagewise exposure. It has been desirable to increase the charge sensitivity of such elements. Increased charge sensitivity would lower the levels of charge required to form a latent image in the electrically activated recording layer.

Attempts have been made to increase charge sensitivity by means of various polymeric layers between the electrically conductive support and the electrically activated recording layer. However, many polymeric materials do not provide a suitable increase in charge sensitivity. This is illustrated by the comparative information in U.S. Pat. No. 4,309,497. While certain halogen-containing polyesters in electrically active conductive layers have provided increased charge sensitivity in an electrically activatable recording element, it has been found that halogen-containing polyesters as a class do not provide such increased charge sensitivity. For example, it was found, as illustrated in following comparative examples 16, 17, 18, 19 and 20, that poly(pentachlorophenoxyethyl methacrylate), poly(pentachlorophenoxyethylacrylate-co-N-laurylmethacrylate), poly(-pentachlorophenoxyethylmethacrylate-co-N-laurylmethacrylate), poly(tribromophenoxyhexyl acrylate), and poly(tribromophenoxybutyl acrylate) do not provide such increased charge sensitivity. It has been desirable to replace the halogen-containing polyesters described in U.S. Pat. No. 4,309,497 with halogen-containing polyvinyl esters because the halogen-containing polyvinyl esters are simpler to prepare. A problem was what halogen-containing polyvinyl esters were useful to provide increased charge sensitivity in an electrically active conductive layer. No answer to this problem was suggested in the art. No suggestion was made in the art that a particular glass transition temperature was an important factor in the answer to the problem.

SUMMARY OF THE INVENTION

It has been found that increased charge sensitivity is produced in an electrically activatable recording element comprising a polymeric electrically active conductive (EAC) layer wherein the EAC layer comprises a polymer having recurring units represented by the structure:

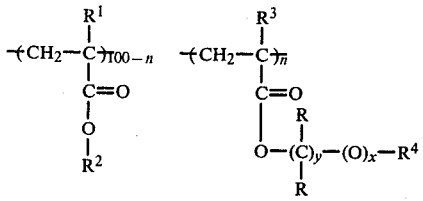

wherein

R is hydrogen or alkyl containing 1 to 20 carbon atoms, such as methyl, ethyl, propyl, butyl, decyl and icocyl;

$R^1$ and $R^3$ are individually hydrogen or methyl;

$R^2$ is alkyl containing 2 to 20 carbon atoms, such as methyl, ethyl, propyl, butyl, pentyl, decyl and eicosyl;

x is 0 or 1;

y is 0 to 4;

$R^4$ is $C_6H_{5-z}X_z$; wherein z is 1 to 5;

X is chlorine, bromine or iodine;

n is 40 to 100 weight percent; and wherein the copolymer has a glass transition temperature which is within the range of 20° C. to 40° C., preferably 20° C. to 30° C.

Such a polymer is useful as a polymeric electrically active conductive layer in an electrically activatable recording element comprising an electrically conductive support having thereon, in sequence:

(a) a polymeric electrically active conductive layer, (b) an electrically activatable recording layer comprising:

(A) a dye-forming coupler, and (B) an oxidation-reduction combination comprising:

(i) an organic silver salt oxidizing agent consisting essentially of a silver salt of a 1,2,4-mercaptotriazole derivative with (ii) a reducing agent which, in its oxidized form, forms a dye with the dye-forming coupler, (c) a photoconductive layer separated from (b) by an air gap of up to 20 microns or separated from (b) by an electrically conductive interlayer, and (d) an electrically conductive layer, preferably on a second support.

The described polymer as a component of the electrically active conductive layer has an effective glass transition temperature (Tg°C.) that enables the polymer to provide increased sensitivity to the recording element.

Other transducers than photoconductors are useful for providing a developable latent image in the electrically activatable recording layer of the element.

It has also been found according to the invention that a dye image and silver image, especially a dye-enhanced silver image, is produced in an electrically activatable recording element according to the invention by (a) imagewise producing in the recording layer of the element a charge density sufficient to form a latent image in the recording layer, and then (b) developing the latent image, preferably by heating the recording layer to a temperature and for a time sufficient to produce a desired dye image and silver image.

For example, it has also been found according to the invention, that a dye image and silver image, especially a dye-enhanced silver image, is produced by an electrically activated recording process comprising the steps of:

(I) imagewise applying an electric potential, of a magnitude and for a time sufficient to produce in the image areas a charge density which enables formation of a latent image, such as a charge density within the range of about $10^{-8}$ to about $10^{-5}$ coulomb/cm$^2$ in an electrically activatable recording layer of a charge sensitive recording element having a polymeric electrically active conductive layer according to the invention; and, then (II) heating the element substantially uniformly at a temperature and for a time sufficient to produce a dye image and silver image in the recording layer.

In this process embodiment, a contact or noncontact electrode is useful in place of a photoconductor to produce the desired charge density in the recording layer. Another means for producing the desired charge density comprises a corona ion current flow to produce a developable latent image in the recording element.

The heating step in each of the process embodiments of the invention is carried out at a temperature within the range of about 80° C. to about 200° C., generally at a temperature within the range of about 100° C. to about 180° C. until the desired silver image and dye image are formed.

The polymers in the EAC layer of an electrically activatable recording element according to the invention are advantageous because in addition to providing increased charge sensitivity, they are easily prepared to provide desired physical properties, including solubility and glass transition temperature.

DETAILED DESCRIPTION OF THE INVENTION

Figure 1:
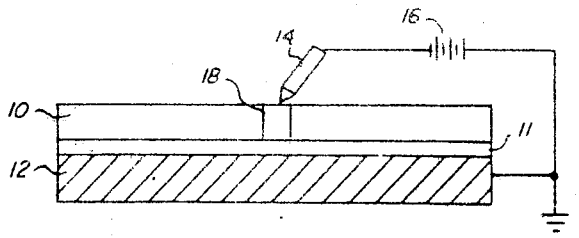
FIGS 1 and 2 schematically illustrate an image recording material and process according to one embodiment of the invention.

Many polymers having the described recurring units are useful as the polymeric EAC layer in an electrically activated recording element according to the invention. The exact mechanisms by which the latent image is formed and by which the polymeric EAC layer enables increased charge sensitivity in an element according to the invention are not fully understood. It is postulated that the injection of a charge carrier due to the electric field into the combination of components results in the formation of a latent image in the electrically activated recording layer.

Some form of interaction which is not fully understood occurs between the electrically activated recording layer and the polymeric EAC layer. For reasons not fully understood, the image forms in the exposed areas in the recording layer closest to the interface between the electrically activated recording layer and the polymeric EAC layer, rather than uniformly through the exposed areas of the electrically activated recording layer.

It is believed that the development of the latent image is accomplished by a reaction in which the latent image catalyzes the reaction of the described image-forming combination. In such a reaction, the organic silver salt oxidizing agent reacts with the reducing agent. Then, the oxidized form of the reducing agent resulting from the reaction in turn reacts with the dye-forming coupler to produce a dye in the image areas. It is not entirely clear, however, what part, if any, the dye-forming coupler plays in latent image formation.

While many image recording combinations containing the described components are useful, the optimum image recording combination and image recording element will depend upon such factors as the desired image, particular dye-forming coupler, particular organic silver salt oxidizing agent and reducing agent, the source of exposing energy, processing condition ranges and particular EAC layer.

The term "electrically active conductive" herein has been abbreviated as "EAC". This term describes a layer according to the invention which is located between the electrically activatable recording layer (the layer in which a latent image is formed) and the electrically conductive support of an element according to the invention. This EAC layer is described as electrically active because the image recording layer exhibits the desired degree of increased sensitivity when electrical current is passed through the layers during imagewise exposure. The EAC layer is differentiated from a layer that is merely electrically conductive because the EAC layer influences the charge sensitivity of the recording layer, whereas a layer that is merely electrically conductive does not influence the recording layer in such a manner.

The term "latent image" herein means an image that is not visible to the unaided eye or is faintly visible to the unaided eye and that is capable of amplification in a subsequent processing step, especially in a subsequent heat development step.

The term "electrically conductive" such as an "electrically conductive support" or "polymeric electrically active conductive layer" herein means a material that has a resistivity less than about $10^{12}$ ohms-cm.

The polymers useful in a polymeric EAC layer according to the invention are prepared by methods known in the polymer art. The method of preparation is selected which produces a polymer having the most useful solubility and glass transition temperature.

The following preparation is illustrative of the method for preparing monomers from which the polymers for a polymer EAC layer according to the invention are prepared. The following reaction sequence illustrates the preparation of a monomer for preparation of a polymer according to the invention:

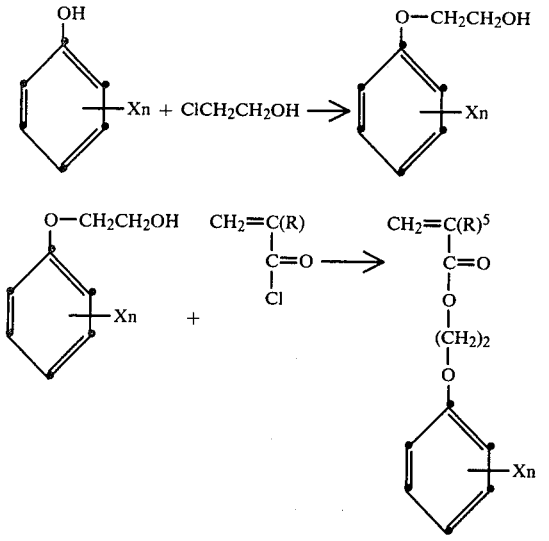

wherein $R^5$ is hydrogen or methyl;

X is chlorine, bromine or iodine; and n is 1 to 5.

The synthesis for a monomer wherein $R^5$ is methyl, X is bromine and n is 5 is as follows:

Pentabromophenol (97.8 g) (0.2 M) is treated with 16 g of sodium hydroxide in 400 ml of distilled water to produce a clear, pale yellow solution. To this solution is added dropwise over a period of 30 minutes, 25 g (0.3 M) 2-chloroethanol, and the reaction is continued with stirring for 3 hours at about 100° C. During this period a white precipitate is formed. After cooling, the solids are filtered and recrystallized from toluene to produce a white crystalline product having a melting point of 114° C., which is 2-pentabromophenoxyethanol. The product is also identified by nuclear magnetic resonance.

The 2-pentabromophenoxyethanol (32 g) (0.06 M) is dissolved in a solution of N-methylmorpholine in 150 ml of toluene and 7.3 g (0.07 M) methacryloyl chloride is added dropwise to the stirred solution. The reaction is continued at 60° C. for 3 hours. After filtration the toluene solution is washed with water, dried and concentrated to produce a white, crystalline product having a melting point of 140° C. This product is pentabromophenoxyethyl methacrylate. The product is identified by nuclear magnetic resonance analysis.

The halogen-containing acrylate and methacrylate monomers prepared according to the above procedure can be copolymerized with vinyl monomers which provide desired glass transition temperature ranges. Such vinyl monomers include for example, butyl acrylate, octyl acrylate and dodecyl methacrylate. The polymerization is by means of a free radical technique known in the polymerization art. Appropriate monomer mixtures are dissolved in toluene at a monomer:solvent ratio of about 1:4 and about 1 to 2 weight percent (based on monomer) of a polymerization initiator. 2,2'-Azobis(2-methylpropionitrile) is added as a polymerization initiator. Polymerization is conducted under a nitrogen atmosphere at 60° C. for 20 to 40 hours. Copolymer products are isolated by precipitation into a nonsolvent, such as methanol, followed by filtration and drying. A nonsolvent herein means a solvent in which the copolymer is not soluble. By adjusting the monomer:-solvent ratio and initiator concentration, copolymers are prepared having inherent viscosities as desired, such as a viscosity equal to or less than about 0.2 (0.25 weight percent solids, tetrahydrofuran at 25° C.).

A preferred copolymer prepared according to the above procedure is one represented by the following struture having the repeating units:

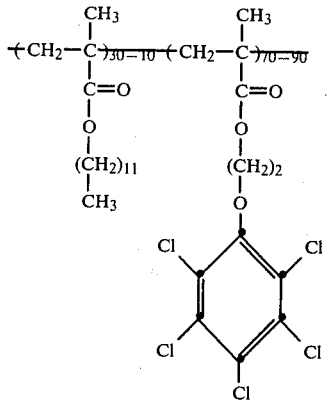

A highly preferred homopolymer is poly(tribromophenoxypropyl acrylate).

The electrically active conductive layer comprises a polymer which is generally coatable from an organic solvent. Examples of solvents useful for coating purposes include dichloromethane, chloroform, acetone and 1,2-dichloropropane.

The following polymers are examples of copolymers that are useful as polymeric EAC layers according to the invention:

| Polymer Number | Polymer | (Weight % Ratio) |
|---|---|---|
| 1 | Poly(pentachlorophenoxyethyl methacrylate-co-n-lauryl methacrylate) | (80:20) or (60:40) |
| 2 | Poly(pentachlorophenoxyethyl acrylate-co-n-lauryl methacrylate) | (95:5) or (90:10) |
| 3 | Poly(tribromophenoxyethyl methacrylate-co-n-lauryl methacrylate) | (80:20) |
| 4 | Poly(trichlorophenoxyethyl methacrylate-co-n-lauryl methacrylate) | (80:20) |
| 5 | Poly(triiodophenoxyethyl methacrylate-co-n-lauryl methacrylate) | (80:20) |
| 6 | Poly(tribromophenoxyethyl methacrylate) | (100) |
| 7 | Poly(tribromophenoxypropyl acrylate) | (100) |
| 8 | Poly(pentachlorophenoxyethyl methacrylate) | (100) |
| 9 | Poly(pentachlorophenoxyethyl acrylate) | (100) |
| 10 | Poly(pentachlorophenoxyethyl methacrylate) | (100) |
| 11 | Poly(trichlorophenoxyethyl methacrylate) | (100) |
| 12 | Poly(triiodophenoxyethyl methacrylate) | (100) |

Inherent viscosity of the polymer that comprises the polymeric EAC layer influences the selection of an optimum polymer according to the invention because this property of the polymer is related to the glass transition temperature of the polymer, which, in turn, influences the charge sensitivity of the recording layer according to the invention. The inherent viscosity of the polymer is determined by procedures known in the polymer art. The inherent viscosity of the polymer is determined, for example, by means of 100 ml of a 0.25 percent by weight solution of the copolymer in tetrahydrofuran (THF) in an automated capillary viscometer. A preferred inherent viscosity for a polymer is within the range of about 0.03 to about 0.30, such as about 0.1 to about 0.2.

The glass transition temperature of the polymer that comprises the polymeric EAC layer is within the range of about 20° C. to 40° C., preferably 20° C. to 30° C. The glass transition temperature is determined by procedures known in the polymer art and comprises the range of temperatures over which the specific heat and thermal coefficient of expansion of the polymer undergoes discontinuities. Below the glass transition temperature the material is glass-like in character and above this temperature, the material is fluid-like. Combinations of polymers are optionally useful for a polymeric EAC layer according to the invention to provide the optimum inherent viscosity and glass transition temperature ranges for a polymeric EAC layer according to the invention.

Many photoconductors are useful in an element according to the invention. Selection of an optimum photoconductor will depend upon such factors as the particular electrically activatable recording layer, the charge sensitivity of the element, the desired image, ohmic resistivity desired, exposure means, processing conditions and particular polymer for the polymeric EAC layer. It is advantageous to select a photoconductor which has the property of being most useful with the operative voltages for imaging. The photoconductor is either an organic photoconductor or an inorganic photoconductor. Combinations of photoconductors are useful. The resisitivity of the photoconductor can change rapidly in the operating voltage ranges that are useful. In some cases it is desirable that the photoconductive layer have persistent conducitivity. Examples of useful photoconductors include lead oxide, cadmium sulfide, cadmium selenide, cadmium telluride and selenium. Useful organic photoconductors include, for instance, polyvinylcarbazole/trinitrofluorenone photoconductors and aggregate type organic photoconductors described in, for example, U.S. Pat. No. 3,615,414. These photoconductors are known in the image recording art and are described in for example, U.S. Pat. No. 3,577,272; *Research Disclosure,* August 1973, Item No. 11210 and "Electrophotography" by R. M. Schaffert (1975).

An illustrative photoconductive layer comprises a dispersion of a lead oxide photoconductor in an insulating binder, such as a binder comprising a polycarbonate (for example, LEXAN, a Trademark of the General Electric Company, U.S.A. consisting of a bisphenol A polycarbonate), polystyrene or poly(vinylbutyral).

Many dye-forming couplers are useful in an electrically activatable recording element and process of the invention. The exact mechanism by which the dye image and silver image are produced is not fully understood. It is believed that the dye-forming coupler reacts with the oxidized form of the reducing agent to form a dye. The term dye-forming coupler herein means a compound or combination of compounds which with other of the components, produces a desired dye image upon heating the recording layer after exposure. These are designated as dye-forming couplers because it is believed the compounds couple with the oxidized reducing agent to produce a dye. Dye-forming couplers are known in the photographic art as color-forming couplers. Selection of an optimum dye-forming coupler will be influenced by such factors as the desired dye image, other components of the recording layer, processing conditions, particular reducing agent in the recording layer, and the binder in the recording layer. An example of a useful magenta dye-forming coupler is 1-(2,4,6-trichlorophenol)-3-[3-]α-(3-pentadecyl-phenoxy)-butyramido[benzamido]-5-pyrazolone. A useful cyan dye-forming coupler is 2,4-dichloro-1-naphthol. A useful yellow dye-forming coupler is α-[3-[α-(2,4-di-tertiaryamylphenoxy)acetamido]benzoyl]-2-fluoroacetanilide. Useful cyan, magenta and yellow dye-forming couplers are selected from for example, those described in, for instance, "Nebletts Handbook of Photography and Reprography," edited by John M. Sturge, 7th Edition, 1977, pages 120–121 and *Research Disclosure,* December 1978, Item No. 17643.

An especially useful dye-forming coupler is a resorcinol dye-forming coupler. The resorcinol dye-forming coupler is preferable because many resorcinol dye-forming couplers produce a neutral (black) or nearly neutral appearing dye with the oxidized form of the described reducing agent. Examples of useful resorcinol dye-forming couplers are described in *Research Disclosure,* September 1978, Item No. 17326 and U.K. Published Application No. 2,018,453A. Preferred resorcinol dye-forming couplers include 2′,6′-dihydroxyacetanilide and 2′,6′-dihydroxytrifluoroacetanilide. Another useful resorcinol dye-forming coupler is 2′,6′-dihydroxy-2,5-dimethylbenzanilide. Resorcinol dye-forming couplers are prepared by procedures known in the chemical arts. For example, resorcinol couplers are prepared from amino resorcinols or dihydroxybenzoic acids.

The dye-forming coupler is useful in a range of concentrations in the electrically activatable recording layer. Selection of an optimum concentration of dye-forming coupler will depend upon such factors as the particular coupler, the desired image, processing conditions, other components in the recording layer and the particular reducing agent in the recording layer. The recording layer contains a concentration of dye-forming coupler that is generally within the range of about 0.1 to about 1.0 mole by dye-forming coupler per mole of total silver in the recording layer. A preferred concentration of dye-forming coupler is within the range of about 0.25 to about 0.75 mole of dye-forming coupler per mole of total silver in the recording layer.

Useful organic silver salt oxidizing agents are silver salts of 1,2,4-mercaptotriazole derivatives in the recording layer. Useful silver salts of 1,2,4-mercaptotriazole derivatives include those represented by the formula:

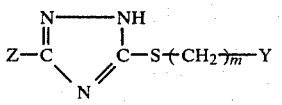

wherein

Y is aryl containing 6 to 12 carbon atoms, such as phenyl, naphthyl and parachlorophenyl;

m is 0, 1 or 2; and

Z is hydrogen, hydroxyl or amine ($-NH_2$).

Preferred organic silver salt oxidizing agents within this class are those silver salts of the 1,2,4-mercaptotriazole derivatives wherein Y is phenyl, naphthyl or parachlorophenyl; and Z is amine.

An example of such a compound is the silver salt of 3-amino-5-benzylthiol-1,2,4-triazole (referred to herein as ABT). Such organic silver salt oxidizing agents are described in, for instance, U.S. Pat. No. 4,123,274 and U.S. Pat. No. 4,128,557. Elements containing these organic silver salt oxidizing agents produce higher speeds than similar elements containing silver behenate or other organic silver salt oxidizing agents.

Combinations of organic silver salt oxidizing agents are also useful. An example of a combination of organic silver salt oxidizing agents is the combination of the silver salt of ABT with the silver salt of 1-methyl-4-imidazoline-2-thiol. Other combinations include the combinations of the silver salt of ABT with the silver salts of nitrogen acids described in, for example, U.S. Pat. No. 4,220,709.

Selection of an optimum organic silver salt oxidizing agent or combination of organic silver salt oxidizing agents will depend upon such factors as the desired image, particular reducing agent, particular dye-forming coupler, processing conditions, and particular binder in the recording layer. A preferred organic silver salt oxidizing agent is the silver salt of ABT.

The organic silver salt oxidizing agent or combination of organic silver salt oxidizing agents are useful in a range of concentrations in the recording layer of an electrically activatable recording element according to the invention. Selection of an optimum concentration of organic silver salt oxidizing agent or combination of organic silver salt oxidizing agents will depend upon the described factors, such as the desired image, particular reducing agent, particular dye-forming coupler, processing conditions and particular binder in the electrically activatable recording layer. A preferred concentration of organic silver salt oxidizing agent or combination of silver salt oxidizing agents is within the range of about 0.1 mole to about 2.0 moles of silver salt oxidizing agent per mole of reducing agent in the recording layer. For instance, when the organic silver salt oxidizing agent is the silver salt of ABT, a preferred concentration of organic silver salt oxidizing agent is within the range of about 0.1 to about 0.2 moles of organic silver salt oxidizing agent per mole of reducing agent in the recording layer.

Preparation of the organic silver salt oxidizing agent is preferably not carried out in situ, that is, not in combination with other components of the recording layer. Rather, the preparation of the oxidizing agent is preferably carried out ex situ, that is, separate from other components of the recording layer. In most instances, the preparation of the organic silver salt oxidizing agent will be separate from the other components based on the ease of control of preparation and storage capability.

The term "salt" herein includes any type of bonding or complexing mechanism which enables the resulting material to produce desired image properties in the recording layer of an element according to the invention. In some instances the exact bonding of the silver salt with the organic compound is not fully understood. Accordingly, the term "salt" includes what are known in the chemical arts as "complexes." The term "salt" includes, for example, neutral complexes and non-neutral complexes.

Many reducing agents which, in their oxidized form, form a dye with the dye-forming coupler are useful in the recording element according to the invention. The reducing agent is preferably an organic silver halide color developing agent. Combinations of reducing agents are useful. It is important that the reducing agent produces an oxidized form upon reaction with the organic silver salt oxidizing agent which reacts at processing temperature with the dye-forming coupler to produce a desired dye. Preferred reducing agents are primary aromatic amines including, for example, paraphenylenediamines. Examples of useful reducing agents which are primary aromatic amines include:

4-amino-N,N-dimethylaniline;

4-amino-N,N-diethylaniline;

4-amino-3-methyl-N,N-diethylaniline (also known as N,N-diethyl-3-methyl-paraphenylenediamine);

4-amino-N-ethyl-N-β-hydroxyethylaniline;

4-amino-3-methyl-N-ethyl-N-β-hydroxyethylaniline;

4-amino-3-methoxy-N-ethyl-N-β-hydroxyethylaniline;4-amino-N-butyl-N-gammasulfobutylaniline;

4-amino-3-methyl-N-ethyl-N-β-sulfoethyl-aniline;

4-amino-3-β-(methanesulfonamido)ethyl-N,N-diethylaniline;

4-amino-3-methyl-N-ethyl-N-β-(methanesulfonamido)ethylaniline; and 4-amino-3-methyl-N-ethyl-N-β-methoxyethylaniline.

The term "reducing agent" herein includes compounds which are reducing agent precursors in the recording layer. That is, those compounds are included which are not reducing agents in the recording layer until a condition occurs, such as heating of the recording layer.

A preferred reducing agent is one that consists essentially of a para-phenylenediamine silver halide developing agent that exhibits an E ½ value in aqueous solution at pH 10 within the range of −25 to +175 millivolts versus SCE. The term "E ½ value" herein means half wave potential. The term "SCE" herein means saturated calomel electrode. These values are determined by analytical procedures known in the photographic art and described in, for example, the text "The Theory of the Photographic Process" 4th edition, edited by T. H. James, 1977, pgs. 318–319.

The described reducing agent is useful in a range of concentrations in an element according to the invention. Selection of an optimum concentration of reducing agent or a combination of reducing agents will depend upon such factors as the desired image, particular organic silver salt oxidizing agent, particular dye-forming coupler, processing conditions and the particular polymer in the EAC layer. A preferred concentration of reducing agent or combination of reducing agents is within the range of about 0.1 to 5.0 moles of reducing agent per mole of organic silver salt in the recording layer. An especially useful concentration of reducing agent is within the range of about 0.2 to about 2 moles of reducing agent per mole of organic silver salt in the recording layer.

The tone of the combined silver image and dye image produced according to the invention will vary depending upon such factors as the silver morphology of the developed silver image, covering power of the silver materials, particular dye-forming coupler, particular developing agent, and processing conditions. In recording layers that produce a brown silver image, the hue of the dye image produced is preferably complimentary in hue to the silver image. An image hue of the combined dye image and silver image is preferably neutral.

The term "neutral" herein includes hues which occasionally are described in the photographic art as blue-black, gray, purple-black, black and the like. Whether or not a given hue is "neutral" is readily determined by visual inspection with the unaided eye.

Procedures for determining whether or not an image is "neutral" are known in the photographic art such as described in *Research Disclosure,* September 1978, Item No. 17326.

Many colloids and polymers, alone or in combination, are useful as vehicles and binding agents in the layers of an electrically activatable recording element according to the invention. These vehicles and binding agents are in various layers of the element, especially in the recording layer. Suitable materials are hydrophobic or hydrophilic. It is necessary that the vehicle or binder in the element not adversely affect the elements charge sensitivity or ohmic resistivity. It is also necessary that the vehicle or binder be compatible with the EAC layer. The selection of an optimum colloid or polymer or combination of colloids or polymers will depend upon such factors as the desired charge sensitivity, desired ohmic resistivity, desired image, particular processing conditions, and particular EAC layer. Useful colloids and polymers are transparent or transluscent and include naturally occuring substances such as proteins, for example, gelatin, gelatin derivatives, cellulose derivatives, and polysaccharides, such as dextran. Synthetic polymers are preferred due to their desired charge sensitivity properties and ohmic resistivity properties. Useful polymeric materials for this purpose include polyvinyl compounds, such as poly(vinylpyrrolidone), acrylamide polymers and dispersed vinyl compounds such as in latex form. Effective polymers include water insoluble polymers of alkyl acrylates and methacrylates containing minor concentrations of acrylic acid, sulfoalkylacrylates or methacrylates and those which have crosslinking sites which facilitate hardening or curing. Preferred polymers are high molecular weight materials and resins which are compatible with the components of the element. These include, for example, poly(vinylbutyral), cellulose acetate butyrate, poly(methylmethacrylate), poly(vinylchloride), ethylcellulose, polystyrene, poly(isobutylene), butadiene-styrene copolymers, vinylchloride-vinylacetate copolymers, copolymers of vinylacetate, vinylchloride and maleic acid and poly(vinyl alcohol). Combinations of colloids and polymers are useful depending upon the described factors. Highly preferred binders include polyacrylamide, as well as copolymers of acrylamide and other vinyl addition monomers such as copolymers of acrylamide and vinylimidizole or copolymers of acrylamide and N-methylacrylamide.

An overcoat layer is optionally useful on the recording layer according to the invention. It is important that the overcoat layer not adversely affect the desired charge sensitivity and ohmic resistivity properties of the element. Such an overcoat layer reduces fingerprinting and abrasion marks before and after exposure and processing. The overcoat layer is one or more of the described polymers which are useful as binders. These materials are required to be compatible with other components of the element and must be able to tolerate the processing temperatures which are usful for developing the described images.

It is generally unnecessary to have a photosensitive component present in the electrically activatable recording element. A photosensitive component herein means any photosensitive material, especially a photosensitive metal salt or complex, which produces developable nuclei upon light exposure. If a photographic component is present in the recording layer, a preferred photosensitive metal salt is photosensitive silver halide due to its desired properties in forming developable nuclei upon charge exposure. A preferred concentration of photosensitive metal salt is within the range of about 0.001 to about 10.0 moles of photosensitive metal salt per mole of organic silver salt in the element. A preferred photosensitive silver halide is silver chloride, silver bromide, silver bromoiodide or mixtures thereof. For purposes of the invention, silver iodide is also considered to be a photosensitive silver halide. Very fine grain photographic silver halide is useful although a range of grain size from fine grain to coarse grain photographic silver halide is suitable in the recording layer. The photosensitive silver halide is prepared by any of the procedures known in the photographic art. Such procedures and forms of photosensitive silver halide are described in, for example, *Research Disclosure,* December 1978, Item No. 17643. The photosensitive silver halide is washed or unwashed, is chemically sensitized if desired by means of chemical sensitization procedures known in the art, and is protected against the production of fog and stabilized against loss of sensitivity during keeping as described in the above Research Disclosure publication.

If a photosensitive component is present in the electrically activatable recording layer, the described image-forming combination enables a lower concentration of the photosensitive component than otherwise would be expected in a photosensitive element. This lower concentration is enabled by the amplification affect of the image-forming combination, as well as the formation of developable nuclei, in addition to the dye enhancement of the silver image formed.

The electrically activatable recording element according to the invention optionally contains addenda which aid in producing a desired image. These addenda include, for example, development modifiers that function as speed increasing compounds, hardeners, plasticizers and lubricants, coatings aids, brighteners, spectral sensitizing dyes, absorbing and filter dyes. These addenda are described in, for example, *Research Disclosure,* December 1978, Item No. 17643 and U.S. Pat. No. 4,234,670.

A post-processing stabilizer or stabilizer precursor is optionally present in the recording layer to increase post-processing stability of the developed image. The recording layer following processing generally is sufficiently stable to avoid the need for incorporation of a stabilizer or stabilizer precursor in the recording layer. In the case of recording materials which contain photosensitive silver halide, such a stabilizer or post-processing stabilizer precursor is optionally included to provide increased post-processing stability. Many stabilizers and stabilizer precursors are useful in elements according to the invention containing photosensitive silver halide. These stabilizers and stabilizer precursors are useful alone or in combination. Useful stabilizers and stabilizer precursors include, for instance, photolytically active polybrominated organic compounds. Thioethers or blocked azolinethiones stabilizer precursors are also useful.

When a stabilizer or stabilizer precursor is present in the electrically activatable recording element according to the invention, a range of concentrations of stabilizer or stabilizer precursor is useful. The optimum concentration of stabilizer or stabilizer precursor depends upon such factors as the particular element, processing conditions, particular stabilizer or stabilizer precursor, and desired stability of the developed image. A preferred concentration of stabilizer or stabilizer precursor is within the range of about 1 to about 10 moles of stabilizer or stabilizer precursor per mole of photosensitive component in the element.

It is often advantageous to include a heat sensitive base release agent or base precursor in the recording element according to the invention to produce improved and more effective image development. A base release agent or base precursor herein includes compounds which upon heating in the recording layer produce a more effective reaction between the described components of the image-forming combination and produce improved reaction between the oxidized form of the described producing agent and the dye-forming coupler. Examples of useful heat sensitive base release agents or base precursors are aminimide base release agents, such as described in *Research Disclosure,* May 1977, Item Nos. 15733, 15732, 15776 and 15734; quanidinium compounds, such as quanidinium trichloroacetate and other compounds which are known in the photothermographic art to release a base moiety upon heating, but do not adversely affect the desired properties of the recording element. Combinations of heat sensitive base release agents are useful.

A heat sensitive base release agent or base precursor or combination of such compounds is useful in a range of concentrations in the elements according to the invention. The optimum concentration of heat sensitive base release agent or base precursor will depend upon such factors as the desired image, particular dye-forming coupler, particular reducing agent, other components in the image-forming element, processing conditions and the like. A preferred concentration of base release agent is generally within the range of about 0.25 to about 2.5 moles of base release agent or base precursor per mole of reducing agent in the recording layer.

Many electrically conductive supports are useful in an electrically activatable recording element according to the invention. The term "electrically conductive support" herein means (a) supports that are electrically conductive without the need for separate addenda in the support or on the support to produce the desired degree of electrical conductivity and (b) supports that comprise addenda or separate electrically conductive layers that enable the desired degree of electrical conductivity. Useful supports include cellulose ester, poly(vinylacetal), poly(ethylene terephthalate), polycarbonate and polyester film supports and related films and resinous materials. Other supports are useful, such as glass, paper, metal and the like which can withstand the processing temperatures and do not adversely affect the charge sensitivity and ohmic resistivity which are desired in the element. A flexible support is generally most useful. An example of a preferred electrically conductive support is a poly(ethylene terephthalate) film having a polymeric subbing layer, such as a poly(methylacrylate-co-vinylidene chloride-co-itaconic acid) subbing layer and having a layer of cermet on the subbing layer.

The electrically activatable recording element according to the invention generally includes an electrically conductive layer positioned between the support and the polymeric EAC layer. This is illustrated by electrically conductive layer 55 in FIG. 5. The electrically conductive layers, as described, such as layers 62 and 55 in FIG. 5 comprise a variety of electrically conducting compounds which do not adversely affect the charge sensitivity and ohmic resistivity of an element according to the invention. Examples of useful electrically conductive layers include layers comprising an electrically conductive chromium composition such as cermet and nickel, copper, cuprous iodide and silver.

Figure 5:
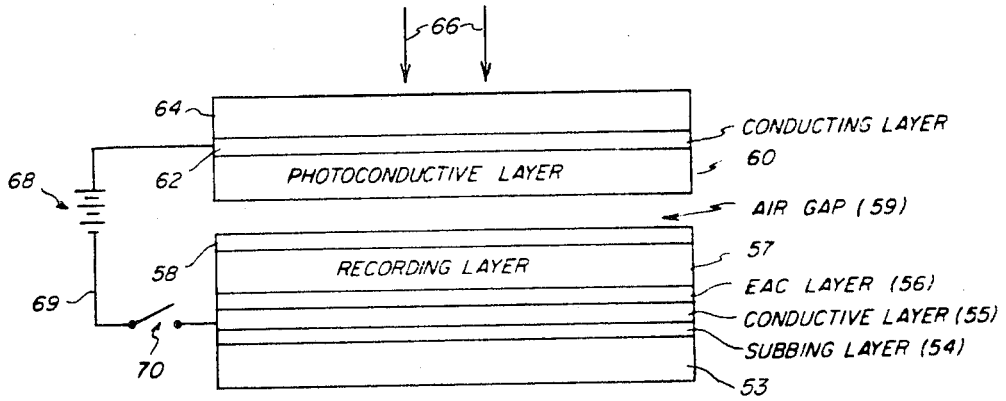
FIG. 5 illustrates schematically an image recording material that is very useful according to the invention.

In some embodiments of the invention, the photoconductive layer is a self-supporting layer, such as a photoconductive in a suitable binder. In such embodiments, an electrically conductive layer such as an electrically conductive nickel or chromium composition layer is coated on the photoconductive layer. This is illustrated in, for example, FIG. 3 in the drawings, in which electrically conductive layer 28 is on photoconductive layer 30 which is self-supporting. Optionally, the photoconductive layer is coated on an electrically conductive support such as illustrated in FIG. 5 of the drawings.

The described layers are coated by coating procedures known in the photographic art including vacuum deposition, dip coating, air knife coating, curtain coating or extrusion coating using hoppers known in the photographic art. Two or more layers are optionally coated simultaneously.

The various components of the electrically activatable recording element are prepared for coating by mixing the components with suitable solutions or mixtures including suitable organic solvents, depending on the particular electrically activatable recording material and the components. The components are added and mixed by means of procedures known in the photographic art.

Preferred electrically activatable recording elements comprise an electrically conductive support having thereon an electrically activatable recording layer which has a thickness within the range of about 1 to about 30 microns, preferably within the range of about 2 to about 15 microns. The optimum layer thickness of each of the layers of an element according to the invention will depend upon such factors as the particular ohmic resistivity desired, charge sensitivity, particular components of the layers and the desired image.

The polymeric EAC layer, such as layer 56 illustrated in FIG. 5, preferably has a thickness within the range of about 0.02 to about 10 microns, such as within the range of about 0.05 to about 5 microns. The optimum layer thickness of the polymeric EAC layer depends upon such factors as the particular ohmic resistivity desired, charge sensitivity, desired image and the particular electrically activatable recording layer.

A "melt-forming compound" is useful in the recording layer to produce an improved developed image. A "melt-forming compound" is preferred with recording materials containing silver salts of nitrogen acids. The term "melt-forming compound" herein means a compound which upon heating to the described processing temperature produces an improved reaction medium, preferably a molten medium, wherein the described image-forming combination produces a desired image upon development. The exact nature of the reaction medium at processing temperature is not fully understood. It is believed that at the reaction temperature, a melt occurs which permits the reaction components to better interact. If desired, a melt-forming compound can be included with other components of the recording layer prior to coating on the support. Examples of useful melt-forming compounds include succinimide, dimethylurea, sulfamide, acetamide and resorcinol.

The organic silver salt oxidizing agent in the recording layer contains a range of ratios of the organic moiety to the silver ion. The optimum ratio of the organic moiety to silver ion in the organic silver salt oxidizing agent depends upon such factors as the particular organic moiety, the particular concentration of silver ion desired, processing conditions, and the particular dye-forming coupler. The molar ratio of organic moiety to silver as silver ion in the salt is generally within the range of about 0.5:1 to about 3:1.

The image recording layer of the invention has a range of pAg. The pAg is measured by means of conventional calomel and silver-silver chloride electrodes, connected to a commercial digital pH meter. Preferably the pAg in a dispersion containing the described components for the recording layer is within the range of about 2.5 to about 7.5. The optimum pAg will depend upon the described factors, such as the desired image, processing conditions and the particular EAC layer.

A recording material containing the organic silver salt oxidizing agent preferably has a pH that is within the range of about 1.5 to about 7.0. A preferred pH for the recording layer is within the range of about 2.0 to about 6.0.

The desired resistivity characteristics of an electrically activatable recording element according to the invention are obtained by separately measuring the current-voltage characteristic of each sample coating at room temperature by means of a mercury contact on the surface of the coating. To eliminate the possibility that a micro thickness surface air gap might affect the measured resistivity, exposures are made with an evaporated metal (bismuth or aluminum) electrode on the surface of an electrically activatable recording layer to be tested. The resistivity is measured at various ambient temperatures. The data is measured at a voltage within the range of, for example, $10^2$ volts to $10^5$ volts/cm, which is within the ohmic response range of the recording layer to be tested. It is expected that the resistivity of the recording layer will vary widely with temperature. It is also expected that the dielectric strength of the layer will vary with temperature.

An illustrative embodiment of the invention comprises an electrically activatable recording element preferably having an ohmic resistivity of at least about $10^7$ ohm-cm, comprising in sequence:

(a) a first electrical conducting layer,
(b) a photoconductive layer,
(c) an electrically activatable recording layer separated from (b) by an air gap of up to about 20 microns or separated from (b) by an electrically conductive interlayer and comprising, in reactive association:
  (A) a dye-forming coupler consisting essentially of a resorcinol coupler such as 2′,6′-dihydroxytrifluoroacetanilide,
  (B) an image-forming combination consisting essentially of
    (i) an organic silver salt oxidizing agent consisting essentially of a silver salt of 3-amino-5-benzylthio-1,2,4-triazole, with
    (ii) a reducing agent consisting essentially of a phenylenediamine silver halide developing agent, such as 4-amino-2-methoxy-N,N,5-trimethylaniline sulfate, and
  (C) a polyacrylamide binder,
(d) a polymeric EAC layer consisting essentially of poly(pentachlorophenoxyethylmethacrylateco-n-laurylmethacrylate) (80:20) or poly(tribromophenoxypropyl acrylate), preferably having a glass transition temperature within the range of 20° to 30° C., on
(e) a second electrical conducting layer, on
(f) a support.

Many energy sources are useful for imagewise exposure of a recording element of the invention. Selection of an optimum energy source for imagewise exposure will depend upon such factors as the sensitivity of the recording layer, sensitivity of the photoconductor, the particular image recording combination in the electrically activatable recording layer, desired image and processing conditions. Useful energy sources for imagewise exposure include for example, visible light, x-rays, lasers, electron beams, ultraviolet radiation, infrared radiation and gamma rays. The electrically activatable recording layer is also sensitive to direct electrical contact by means of a contact electrode, such as a stylus.

An illustrative process according to the invention which produces a dye image and silver image comprises the steps:

(I) imagewise altering the conductivity of the photoconductive layer of the electrically activatable recording element according to the invention in accord with an image to be recorded;
(II) applying across the photoconductive layer and the recording layer an electrical potential of a magnitude and for a time sufficient to produce a developable latent image in the recording layer corresponding to the image to be recorded; and then
(III) heating the recording layer substantially uniformly at a temperature and for a time sufficient to produce a dye image and a silver image, preferably a dye-enhanced silver image, in the recording layer.

The step (I) of imagewise altering the conductivity of the photoconductive layer is preferably carried out while simultaneously (II) applying the described electrical potential across the photoconductive layer and recording layer.

A further illustrative process of the invention is an electrically activated recording process for producing a dye image and silver image, preferably a dye-enhanced silver image, in an electrically activated recording element, having a polymeric EAC layer according to the invention, comprising the steps:

(I) imagewise altering the conductivity of a photoconductive layer in accord with an image to be recorded;
(II) positioning the imagewise altered photoconductive layer from (I) in face-to-face relationship with an electrically activatable recording layer of the recording element;
(III) applying across the photoconductive layer and the recording layer, an electrical potential of a magnitude and for a time sufficient to produce in the areas of the recording layer corresponding to the imagewise altered portions of the photoconductive layer, a current density within the range of about $10^{-5}$ coulomb/cm$^2$ to about $10^{-8}$ coulomb/cm$^2$, the current density forming in the areas a developable latent image; and then (IV) uniformly heating the recording element at a temperature and for a time sufficient to produce a dye image and silver image, preferably a dye-enhanced silver image, in the recording element.

Another illustrative process of the invention is a dry electrically activated recording process for producing a dye image and silver image, preferably a dye-enhanced silver image, in an electrically activatable recording element having a polymeric EAC layer according to the invention, preferably having an ohmic resistivity within the range of about $10^4$ to about $1\times10^{12}$ ohm-cm, containing at least one electrically activatable recording material comprising in a suitable binder, such as polyacrylamide, (A) a dye-forming coupler, and (B) an image-forming combination comprising:

(i) an organic silver salt oxidizing agent, preferably a silver salt of a 1,2,4-mercaptotriazole derivative, with (ii) a reducing agent which, in its oxidized form, forms a dye with the dye-forming coupler; comprising the steps:

(I) positioning the recording material on an electrically conductive backing member;

(II) modulating a corona ion current flow to the recording element by an electrostatic field established imagewise between an image grid comprising an electroconductive core sequentially connectable to sources of different potential relative to the backing member and covered with a coating of a photoconductive insulating material and a control grid that is electrically conductive and sequentially connectable to sources of different potential relative to the backing member, said current flow being of a magnitude sufficient to produce a current density within the range of about $10^{-5}$ to about $10^{-8}$ coulomb/cm$^2$ imagewise in the recording element, which current density forms a developable latent image in the electrically activated recording material; and, then (III) substantially uniformly heating the recording element at a temperature and for a time sufficient to produce a dye image and silver image in the recording element.

A preferred process embodiment of the invention is a dry electrically activated recording process for producing a dye-enhanced silver image in an electrically activatable recording element, preferably having an ohmic resistivity of at least about $10^4$ ohm-cm, comprising, in sequence, a support having thereon:

(a) a first electrically conductive layer, (b) an organic photoconductive layer, (c) an electrically activatable recording layer separated from (b) by an air gap of up to 20 microns or separated from (b) by an electrically conductive interlayer, and comprising:

(A) a dye-forming coupler consisting essentially of 2,6-dihydroxyacetanilide and 2′,6′-dihydroxytrifluoroacetanilide and combinations thereof, (B) an image-forming combination comprising:

(i) an organic silver salt oxidizing agent consisting essentially of a silver salt of 3-amino-5-benzylthio-1,2,4-triazole, with (ii) a reducing agent consisting essentially of a phenylenediamine silver halide developing agent, such as 4-amino-2-methoxy-N,N5-trimethylanilinesulfate, and (iii) a polyacrylamide binder, (d) a polymeric EAC layer of the invention, such as a polymeric EAC layer consisting essentially of poly(-pentachlorophenoxyethylmethacrylate-co-N-laurylmethacrylate) (80:20) or poly(tribromophenoxypropyl acrylate), and (e) a second electrically conductive layer; said process comprising the steps:

(I) imagewise altering the conductivity of the photoconductive layer in accord with an image to be recorded while simultaneously (II) applying across the photoconductive layer and recording layer an electrical potential of a magnitude and for a time sufficient to produce a developable latent image in the recording layer; and then (III) heating the recording layer substantially uniformly at a temperature and for a time sufficient to produce a dye-enhanced silver image in the recording layer.

An imagewise current flow is produced through the electrically activatable recording layer and polymeric EAC layer according to the invention. Although a particular technique to produce an imagewise current flow has been described, preferred techniques are those which include use of a photoconductive layer as an image-to-current converter or use of a direct contact electrode to produce sufficient current to enable formation of a latent image. The imagewise current flow is, for example, optionally provided by contacting the electrically activatable recording element with a suitable electrostatically charged means such as an electrostatically charged stencil or scanning the recording element by means of a beam of electrons.

Heating the electrically activatable recording element after latent image formation is carried out by techniques and by means known in the photothermographic art. For example, heating is carried out by passing the imagewise exposed recording element over a heated platen or drum or through heated rolls, by heating the element by means of microwaves, dielectric heating means, or heated air. A visible image is produced in the described exposed element within a short time, such as within about 1 to about 90 seconds by the described heating step. An image having a maximum transmission density of at least 1.0 and preferably at least 1.5 is produced according to the invention. For example, the recording element is uniformly heated to a temperature within the range of about 100° C. to about 200° C. until a desired image is developed, typically within about 2 to about 90 seconds. The imagewise exposed material is preferably heated to a temperature within the range of about 120° C. to about 180° C. The optimum temperature and time for processing will depend upon such factors as the desired image, the particular recording element and heating means.

The electrically activatable recording element and process according to the invention are useful for producing multiple copies. According to this embodiment, multiple copies are prepared by a dry electrically activated recording process for producing a dye image and silver image, preferably a dye-enhanced silver image, in an electrically activatable recording element comprising the steps of:

(I) imagewise altering the conductivity of a photoconductive layer in accord with an image to be recorded;

(II) positioning the imagewise altered photoconductive layer from step (I) adjacent an electrically activatable recording layer of the invention, (III) applying an electrical potential across the photoconductive layer and recording layer of a magnitude and for a time sufficient to produce in the areas of the recording layer corresponding to the imagewise altered portions of the photoconductive layer a current density within the range of about $10^{-5}$ to about $10^{-8}$ coulomb/cm$^2$, the current density forming in the areas a developable latent image; then (IV) uniformly heating the recording element at a temperature and for a time sufficient to produce a dye image and silver image, preferably a dye-enhanced silver image, in the recording element; followed by (V) positioning the imagewise altered photoconductive layer adjacent a second electrically activatable recording layer, preferably having an ohmic resistivity of at least about $10^7$ ohm-cm; then (VI) applying an electrical potential across the photodconductive layer and the second recording layer of a magnitude and for a time sufficient to produce in the areas of the image of the photoconductive layer a current density within the range of about $10^{-5}$ to about $10^{-8}$ coulomb/cm$^2$, the charge density forming a developable latent image; then (VII) uniformly heating the second recording layer at a temperature and for a time sufficient to produce a developed image in the second recording layer.

While the exact mechanism of image formation upon heating is not fully understood, it is believed that the imagewise exposure to current provides nuclei in the image areas of the recording layer. Such nuclei apparently increase the reaction rate and act as catalysts for the reaction between the organic silver salt oxidizing agent and the reducing agent. It is believed that the nuclei enable a form of amplification which would not otherwise be possible. The organic silver salt oxidizing agent and reducing agent must be in a location with respect to each other which enables the nuclei formed to provide the desired catalytic effect. The organic silver salt oxidizing agent and reducing agent as well as the dye-forming coupler are in reactive association in the electrically activatable recording layer. The term "in reactive association" means that the nuclei resulting from the imagewise exposure are in a location with respect to the other components which enables desired catalytic activity. Such reactive association also enables more useful images and silver images.

Figure 2:
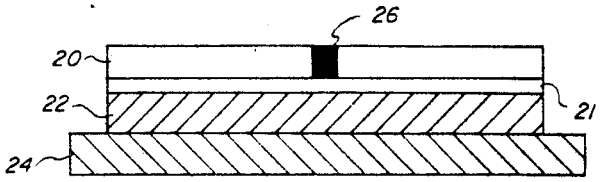

Referring to the drawings, embodiments of the invention are depicted schematically in FIGS. 1 and 2. According to the embodiment illustrated in FIGS. 1 and 2 an electrically activatable recording layer 10 having a polymeric EAC layer 11 according to the invention is placed on a grounded electrically conductive backing or support 12. Layers 10 and 11 are optionally coated on backing or support 12. A current is selectively applied to the recording layer 10 by the point of a metal stylus 14 which is raised to a sufficiently high voltage relative to the support 12 by a voltage source 16 and brought into moving contact with the surface of the recording layer 10 containing the described image-forming combination and dye-forming coupler. Upon contacting the recording layer 10 with the stylus 14 a current flow is produced in the areas, such as area 18, of the recording layer contacted by the stylus. A developable latent image forms, that is a pattern of nuclei sites, in the pattern desired, as illustrated by area 18 in layer 10. The current density produced by the stylus in the contacted areas of the recording layer need not be sufficient to produce a visible image in the recording layer 10. The current density must be sufficient to produce a latent image in the recording layer in those areas contacted by the stylus 14. Although a particular technique to produce an imagewise current flow through the recording layer 10 is illustrated in FIG. 1, techniques for producing an imagewise current flow generally shown in the art of recording are useful and are intended to be encompassed by the description. The area of the recording layer 10 designated as 18 is intended to be illustrative of an area of nuclei sites formed upon contact of the stylus 14 with the recording layer 10. Other techniques for producing a nuclei pattern include, for example, scanning the layer 10 by means of a beam of electrons in an image pattern.

FIG. 2 illustrates development of the latent image formed in the recording element in FIG. 1 by, for example, moving the element from FIG. 1 into contact with a heated metal platen 24. The heat from platen 24 passes through the support 22 and polymeric EAC layer 21 to the layer 20 containing the latent image to cause the desired reaction in the latent image area. The reaction in the latent image area causes development to produce a visible image 26 consisting essentially of a dye image and silver image, preferably a dye-enhanced silver image, in the recording layer 20. Upon development, the recording element is removed from the platen 24. No processing solutions or baths are required in this heat development step.

Figure 3:
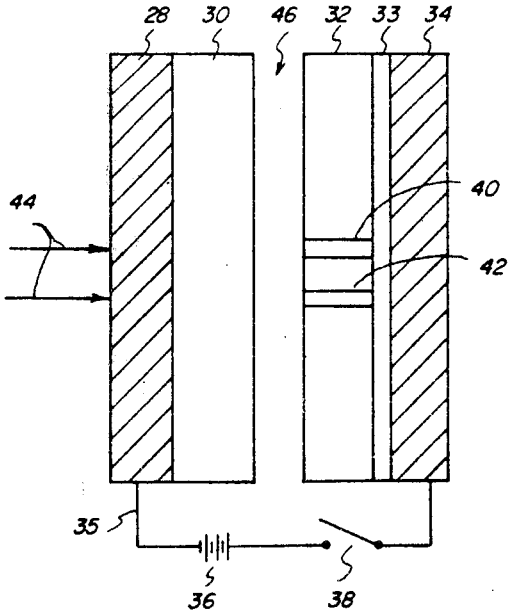
FIGS. 3 and 4 illustrate schematically an electrically activated recording process embodying the described invention.
Figure 4:
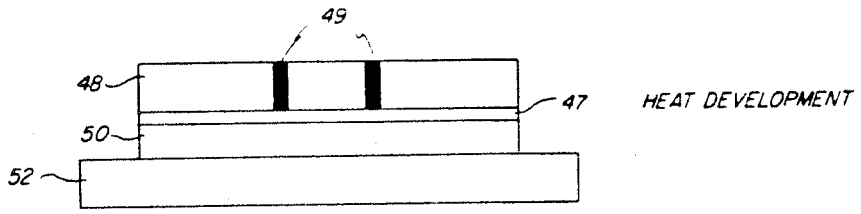

Another illustrative embodiment of the invention is schematically shown in FIGS. 3 and 4. In this embodiment in FIG. 3, the developable sites 40 and 42, that is the latent image sites, are formed by sandwiching a charge sensitive recording layer 32 and an image to current converter, layer 30, preferably a photoconductive layer, between a pair of electrically conductive layers 28 and 34. A polymeric EAC layer 33 of the invention is present between electrically conductive layer 34 and recording layer 32. Layers 28 and 34 comprise suitable supports for layers 30, 32 and 33 or layers 28 and 34 can be on separate suitable supports not shown, such as film supports. A high potential electric field, such as any voltage within the range of about 0.01 to about 6.0 Kv, is established across the photoconductive layer 30 and recording layer 32 by connecting the conductive layers 28 and 34 by connecting means 35 containing power source 36. The electric field across the layers is controlled by switch 38. The latent image formation at sites 40 and 42 is caused by imagewise exposing the photoconductive layer 30 through the conductor 28 to exposure means 44. Exposure means 44 generally comprises actinic radiation, preferably x-rays. The layer 28, and any support for layer 28, must be sufficiently transparent to the energy 44 to enable the energy to pass to a desired degree to photodconductive layer 30. The exposure selectively increases the conductivity of the photoconductive layer in those regions exposed to actinic radiation. When switch 38 is in a closed condition, thereby producing an electric field across the layers, an imagewise current flow is produced through the recording layer 32. The current flow occurs in those regions of the recording layer 32 only in position with the exposed portions of the photoconductive layer 30. An air gap 46 of up to 20 microns is provided between the layers 30 and 32 or 46 may comprise an electrically conductive interlayer, not shown, which does not adversely affect imaging. The air gap 46 is, for example, 1 to 20 microns. After a sufficient current density, preferably less than 10 microcoulomb/cm$^2$ has been produced in the current exposed portions of the recording layer 32, switch 38 is open, thereby disrupting the current flow.

The described technique for application of voltage across the photoconductive and recording layers is illustrative. Techniques known in the recording art as useful and are intended to be included. For example, a grid-control corona discharge means, not shown, such as described in U.S. Pat. No. 3,370,212 is useful in place of the voltage source and conducting layer 28.

To develop the dye image and silver image in latent image sites 40 and 42, the recording element containing layers 32, 33 and 34 is moved away from the photoconductive layer 30. Connecting means 35 is also disconnected. The recording element illustrated in FIG. 4 is then contacted with a heating means such as a heated platen 52 illustrated in FIG. 4. The heat from the platen 52 passes through the support 50 and polymeric EAC layer 47 to the layer 48 containing a latent image to produce a visible dye image and silver image 49. The heating is preferably carried out substantially uniformly by positioning the recording element in heat transfer relationship with the heated platen 52. After development of the silver image and dye image, the recording element is removed from the platen 52.

Another illustrative embodiment of the invention is illustrated in FIG. 5. In FIG. 5 the recording arrangement consists of a support 53 having thereon a polymeric subbing layer 54, such as a poly(alkylacrylate-co-vinylidene chloride-co-itaconic acid) subbing layer, having thereon an electrically conductive layer 55, preferably comprising cermet, and having thereon a polymeric EAC layer 56 according to the invention. The subbing layer 54 helps the conductive layer 55 adhere to the support 53. A recording layer 57 is placed, such as by coating, on the polymeric EAC layer 56. The recording layer 57 contains the image-forming combination and dye-forming coupler. An air gap 59, such as up to 20 microns is present between the overcoat layer 58 on recording layer 57 and photoconductive layer 60. The air gap 59 is optionally replaced by an electrically conductive interlayer that does not adversely affect image recording. The layer 60 is contiguous to an electrically conductive layer 62, such as a nickel layer, which is on a transparent film support 64.

Developable nuclei are formed in recording layer 57 by imagewise exposure by means of a suitable radiation source 66, such as a tungsten light source or x-ray source. At the time of imagewise exposure by means of the energy source 66, a high potential electric field, such as at a voltage within the range of about 0.01 to 6.0 Kv is established across the photoconductive and image recording layers by connecting the conductive layer 62 and electrically conductive layer 55 by connecting means 69 through a power source 68. The electric field across the layers is controlled by switch 70. After the necessary current density is established, switch 70 is opened, thereby disrupting the current flow. Imagewise exposure for about 1 second at about 50 foot candles produces a developable image in recording layer 57. To develop the resulting latent image, layer 55 is disconnected from contacting means 69 and power source 68 and the element containing layer 57 is moved away from the photoconductive layer 60. The recording layer 57 is then heated uniformly by contacting it with a heated metal platen, not shown, until the desired dye image and silver image are produced.

A variety of binders and sensitizers known in the electrophotographic art are useful in the photoconductive layer, such as in layer 60 in FIG. 5. Useful binders are described in, for example, U.S. Pat. No. 2,361,019 and U.S. Pat. No. 2,258,423. Sensitizing compounds useful in the photoconductive layer are described in, for example, U.S. Pat. No. 3,978,335. In the embodiments illustrated which comprise an air gap between the photoconductive layer and image recording layer, the air gap distances are controlled by methods known in the art, such as by the roughness of the surface of the photoconductive layer as well as the roughness of the surface of the image recording layer. The air gap need not be uniform. Best results are observed when a uniform air gap exists between the photoconductive layer and the image recording layer.

The resistivity of a recording layer according to the invention is affected by air gap effects. The number of variables affecting the resistance of the recording layer affects the choice of optimum recording materials and imaging means. The resistivity values described herein are for particular recording materials and are values measured under optimum temperature conditions during exposure.

If desired the recording element and imaging means according to the invention are modified to provide a continuous image recording operation. This is carried out by means of desired control circuitry and continuous transport apparatus not shown.

The following examples are included for a further understanding of the invention.

EXAMPLE 1

Polymeric EAC Layer Containing Polymer 1

This example illustrates the invention.

A poly(ethylene terephthate) film support having a subbing layer containing poly(methylacrylate-co-vinylidene chloride-co-itaconic acid) was coated with a layer of cermet as a conducting layer. Cermet is an electrically conductive silicon and chromium oxide composition, such as described in U.S. Pat. No. 4,010,312. The layer of cermet was then coated with a layer of polymer 1 poly(pentachlorophenoxyethylmethacrylate-co-N-laurylmethacrylate) (80:20) as a polymeric EAC layer. The EAC layer was coated at 0.66 ml/ft$^2$ (0.071 ml/m$^2$) from a 3% by weight solution in 1,2-dichloropropane. The resulting polymeric EAC layer was coated with a composition (A) to produce an electrically activatable recording layer. The composition (A) had the following components:

| | |
|---|---|
| Silver 3-amino-5-benzylthio-1,2,4-triazole (1.5:1 ligand to silver ion ratio; 5.5. mg of Ag per ml; dispersed in 70 percent by volume water and 30 percent ethanol) (organic silver salt oxidizing agent) | 16 mL |
| 3-methyl-5-mercapto-1,2,4-triazole (0.5 percent by weight in ethanol) (antifoggant) | 0.6 mL |
| 2,6-dihydroxytrifluoroacetanilide (128 mg dissolved in 1.0 mL of water) (coupler) | 1.0 mL |
| poly(acrylamide-co-1-vinylimidazole (90:10) (5.6 percent by weight solution in water) (binder) | 0.8 mL |
| 2-methoxy-4-amino-5-methyl-N,N— | 1.0 mL |

-continued

| | |
|---|---|
| dimethyl aniline monohydrate sulfuric acid salt represented by the structure: 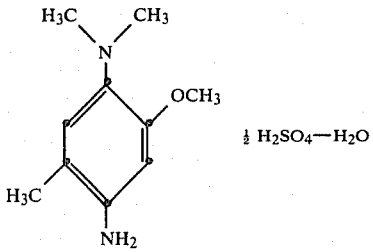 | |
| (75 mg dissolved in 1 mL or water) (developing agent or reducing agent) | |
| 4-phenyl-3-imino-5-thiourazole represented by the structure: 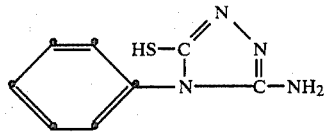 | 0.6 mL |
| (0.5 percent by weight in ethanol) (imaging accelerator) | |
| Surfactant (Surfactant 10G, a para-isononylphenoxypolyglycidol, a trademark of and available from the Olin Corporation, USA) (5 percent by weight in water) | 0.4 mL |
| Mercuric chloride (1.0 mg dissolved in 0.25 mL of ethanol) (antifoggant) | 1.0 mL |

The composition (A) was coated at a 14 mils (350 microns) wet coating thickness to provide a layer containing 120 to 140 mg of silver/ft$^2$ (about 0.13 to about 0.15 mg/cm$^2$) of support.

The resulting electrically activatable recording element was imagewise exposed by means of a grid-controlled corona exposing means, such as described in U.S. Pat. No. 3,370,212. The grid potential of the exposing means was at +150 volts. The charge exposure was varied between 10 and 0.3 microcoulombs/cm$^2$. The intensity and duration of the imagewise exposure was sufficient to produce a developable latent image in the image recording layer.

After exposure, the element containing the latent image was uniformly heated for 8 seconds at 180° C. by a heating means. A developed negative image was produced. The developed image, which consisted of a silver image and a dye image combined, had, at a charge exposure of 1.0 microcoulomb/cm$^2$, a maximum transmission density of 1.0 and a minimum density of 0.20.

EXAMPLE 2

Photoconductive Layer As Light to Current Transducer

This illustrates the invention.

An electrically activatable recording element was prepared as described in Example 1. The polymeric EAC layer in the element was polymer 1. The element was placed in face-to-face relationship with a photoconductive layer comprising a transparent poly(ethylene terephthalate) film support having a nickel coating thereon (electrically conductive layer) and a layer of a photoconductor consisting of tetragonal lead oxide in a poly(styrene-co-butadiene) binder. The photoconductive layer was 90 microns thick. Exposures of the element were by means of a silver test target using a tungsten light source. Exposures were made for 1 second using a commercial sensitometer as the light source. A voltage of 1200 volts was applied to the photoconductor-electrically activated recording layer sandwiched during the exposure with light incident on the photoconductive layer. A positive polarity was applied to the photoconductor.

After exposure, the electrically activatable recording layer was separated from the photoconductive layer and the resulting exposed element was uniformly heated for 5 seconds at 180° C. This produced a dye and silver image corresponding to the exposure. A good quality negative image was produced having a maximum transmission density of 1.3 and a minimum density of 0.20 was produced.

EXAMPLE 3

The procedure described in Example 1 was repeated with the exception that the polymer in the EAC layer was replaced with a polymer consisting of poly(pentachlorophenoxyethyl acrylate-co-N-laurylmethacrylate) (90:10) (Tg of 23° C.).

The image developed had a 1.0 maximum transmission density with a minimum density of 0.22 at a charge exposure of 1.0 microcoulombs/cm$^2$.

EXAMPLE 4

The procedure described in Example 2 was repeated with the exception that the recording layer was exposed for 0.5 seconds and the resulting exposed recording layer was heat processed for 5 seconds at 180° C. to produce a developed image.

A good quality negative image was produced having a maximum transmission density of 1.5 with a minimum density of 0.20.

EXAMPLE 5

The procedure described in Example 1 was repeated with the exception that the polymer in the polymeric EAC layer was replaced by poly(pentachlorophenoxyethyl methacrylate-co-N-laurylmethacrylate) (weight ratio 60:40) (Tg of 22° C.).

The image developed had a maximum transmission density of 1.0 with a minimum density of 0.22 at a charge exposure of 1.5 microcoulombs/cm$^2$.

EXAMPLE 6

The procedure described in Example 1 was repeated with the exception that the polymer in the polymeric EAC layer was replaced by poly(tribromophenoxyethyl methacrylate-co-N-laurylmethacrylate) (weight ratio 80:20) (Tg of 20° C.). A 0.40 maximum transmission density image was obtained at a charge exposure of 0.30 microcoulombs/cm$^2$. The image had a minimum density of 0.22.

EXAMPLE 7

The procedure described in Example 1 was repeated with the exception that the polymer in the polymeric EAC layer was replaced by poly(trichlorophenoxyethyl methacrylate-co-N-laurylmethacrylate) (weight ratio 80:20) (Tg of 31° C.). The recording layer was exposed and heat processed as described in Example 1. A 0.40 maximum transmission density image was obtained for a charge exposure of 3.0 microcoulombs. The image had a minimum density of 0.22.

EXAMPLE 8

The procedure described in Example 1 was repeated with the exception that the polymer in the polymeric EAC layer was replaced by poly(triiodophenoxyethyl methacrylate-co-N-laurylmethacrylate) (weight ratio 80:20) (Tg of 33° C.). The resulting developed image having maximum transmission density of 0.4 with a charge exposure of 3.0 microcoulombs/cm$^2$. The image had a minimum density of 0.22.

EXAMPLE 9

The procedure described in Example 1 was repeated with the exception that the polymer in the polymeric EAC layer was replaced by poly(tribromophenoxypropyl acrylate) (Tg of 23° C.). A 1.0 maximum transmission density image was obtained at a charge exposure of 0.4 microcoulombs/cm$^2$. The image had a minimum density of 0.22.

The following examples are comparative examples:

EXAMPLE 10

Element Without Polymeric EAC Layer

This is a comparative example.

An electrically activatable recording element was prepared as described in Example 1 with the exception that the element contained no EAC layer. The element was imagewise exposed and then uniformly heated as described in Example 1. A charge exposure significantly higher in this example was required to produce a developable image having a maximum transmission density of 1.0.

EXAMPLES 11–15

Comparative Polymers

These are comparative examples.

The procedure described in Example 1 was repeated for each of Examples 11–15 with the exception that in each instance the polymer in the EAC layer described in Example 1 was replaced by the polymer designated in the following Table B. The polymers listed in Table B for each of the Examples 11–15 required imagewise charge exposure significantly higher (more than 10 microcoulombs/cm$^2$) than that required according to Example 1. These examples illustrate that an EAC layer of Example 1 produces significantly increased sensitivity.

The following polymers in these examples were considered unacceptable EAC layers because of high imagewise charge exposure required:

TABLE B

| Example Number | Polymer Name |
|---|---|
| 11 | Poly(2,2'-oxydiethylene:2,2-dimethyl:1,3-propylene terephthalate) |
| 12 | Poly(ethylene:2,2-dimethyl-1,3-propylene 50:50 2,5-dichloroterephthalate) |
| 13 | Poly(2,2-oxyethylene:2,2-dimethyl-1,3-propylene 50:50 azelate:2,5-dibromoterephthalate 50:50) |
| 14 | Poly(4,4'-isopropylidenediphenylene-isophthalate:terephthalate 50:50) |
| 15 | Poly(4,4'-isopropylidene-2,2',6,6'-tetrachlorodiphenylene carbonate) |

EXAMPLE 16

Poly(pentachlorophenoxyethyl methacrylate) as Polymeric EAC Layer

This is comparative example.

The procedure described in Example 1 was repeated with the exception that the EAC layer was replaced by a layer containing poly(pentachlorophenoxyethyl methacrylate) having a glass transition temperature of 97° C. The polymer was found to be an unacceptable polymeric EAC layer because the exposure required to produce a 0.35 image density with a minimun density of 0.20 was at least 10 microcoulombs/cm$^2$. This is significantly higher than the exposure required for polymers according to the invention.

EXAMPLE 17

Poly(pentachlorophenoxyethylacrylate-co-N-laurylmethacrylate) as Polymeric EAC Layer This is a comparative example.

The procedure described in Example 1 was repeated with the exception that the EAC layer of Example 1 was replaced by poly(pentachlorophenoxyethyl acrylate-co-N-laurylmethacrylate) (weight ratio 95:5) (Tg of 45° C.).

An exposure of at least 10 microcoulombs/cm$^2$ was necessary to obtain an image having a 0.30 transmission density with a minimum density of 0.20. This exposure level is significantly higher than the exposure required for polymers according to the invention.

EXAMPLE 18

This a comparative example.

The procedure described in Example 1 was repeated with the exception that the polymer in the polymeric EAC layer was replaced with poly(pentachlorophenoxyethyl methacrylate-co-N-laurylmethacrylate) (weight ratio 40:60) (Tg was −30° C.).

A charge exposure higher than 10 microcoulombs/cm$^2$ was necessary to obtain a visible image.

EXAMPLE 19

This is a comparative example.

The procedure described in Example 1 was repeated with the exception that the polymer in the polymeric EAC layer was replaced by poly(tribromophenoxyhexyl acrylate) (Tg was −19° C.). A charge exposure of more than 10.0 microcoulombs/cm$^2$ was necessary to obtain a visible image.

EXAMPLE 20

This is a comparative example.

The procedure described in Example 1 was repeated with the exception that the polymer in the polymeric EAC layer was replaced by poly(tribromophenoxybutyl acrylate) (Tg was −14° C.). A charge exposure of more than 10.0 microcoulombs/cm$^2$ was necessary to obtain a visible image.

The invention has been described in detail with particular reference to preferred embodiments thereof, but it will be understood that variations and modifications can be effected within the spirit and scope of the invention.

What is claimed is:

1. In an electrically activatable recording element comprising an electrically conductive support having thereon, in sequence:

(a) a polymeric electrically active conductive layer, (b) an electrically activatable recording layer comprising an oxidation-reduction combination comprising:

(i) an organic silver salt oxidizing agent and (ii) a reducing agent, (c) a photoconductive layer separated from (b) either by an air gap of up to 20 microns or by an electrically conductive interlayer; and (d) an electrically conductive layer, the improvement wherein the polymeric electrically active conductive layer comprises a polymer that has recurring units represented by the structure:

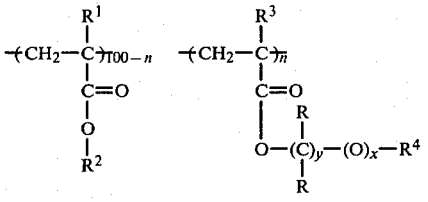

wherein

R is hydrogen or alkyl containing 1 to 20 carbon atoms;

$R^1$ and $R^3$ are individually hydrogen or methyl;

$R^2$ is alkyl containing 2 to 20 carbon atoms;

x is 0 or 1;

y is 0 to 4;

$R^4$ is $C_6H_{5-z}X_z$; wherein z is 1 to 5;

X is chlorine, bromine or iodine;

n is 40 to 100 weight percent;

said polymer having a glass transition temperature which is within the range of about 20° C. to about 40° C.

2. An electrically activatable recording element as in claim 1 wherein said polymer has recurring units represented by the structure:

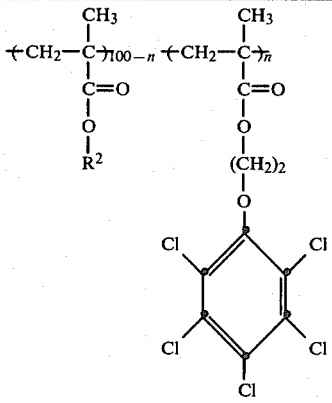

wherein n is about 70 to about 90 weight percent.

3. An electrically activatable recording element as in claim 1 wherein the polymeric electrically active conductive layer consists essentially of a polymer that has recurring units represented by the structure:

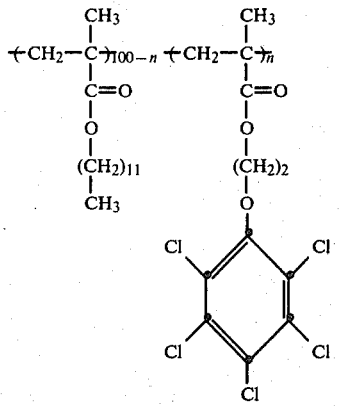

wherein n is about 70 to about 90 weight percent.

4. An electrically activatable recording element as in claim 1 wherein the polymeric electrically active conductive layer consists essentially of poly(tribromophenoxypropyl acrylate).

5. An electrically activatable recording element as in claim 1 comprising an electrically activatable recording layer comprising a dye-forming coupler and an oxidation-reduction combination comprising:

(i) an organic silver salt oxidizing agent with (ii) a reducing agent which, in its oxidized form, forms a dye with said dye-forming coupler.

6. In an electrically activatable recording element comprising an electrically conductive support having thereon, in sequence:

(a) a polymeric electrically active conductive layer, (b) an electrically activatable recording layer comprising:

(A) a dye-forming coupler, and (B) an oxidation-reduction combination comprising:

(i) an organic silver salt oxidizing agent consisting essentially of a silver salt of a 1,2,4-mercaptotriazole derivative with (ii) a reducing agent which, in its oxidized form, forms a dye with said dye-forming coupler, (c) a photoconductive layer separated from (b) by an air gap of up to 20 microns or separated from (b) by an electrically conductive interlayer, and (d) an electrically conductive layer, the improvement wherein the polymeric electrically active conductive layer comprises a polymer having recurring units represented by the structure:

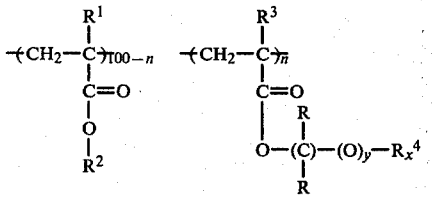

wherein

R is hydrogen or alkyl containing 1 to 20 carbon atoms;

$R^1$ and $R^3$ are individually hydrogen or methyl;

$R^2$ is alkyl containing 2 to 20 carbon atoms;

x is 0 or 1;
y is 0 to 4;
$R^4$ is $C_6H_{5-z}X_z$; wherein z is 1 to 5;
X is chlorine, bromine or iodine;
n is 40 to 100 weight percent;
said polymer having a glass transition temperature which is within the range of about 20° C. to about 40° C.

7. An electrically activatable recording element as in claim 6 wherein said polymer has recurring units represented by the structure:

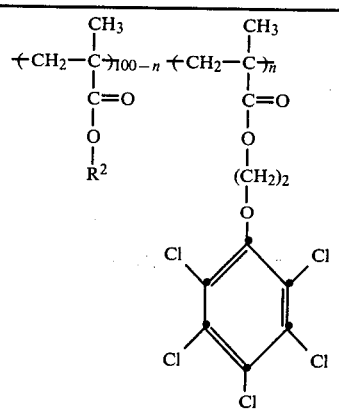

wherein n is about 70 to about 90 weight percent.

8. An electrically activatable recording element as in claim 6 wherein said polymer has recurring units represented by the structure:

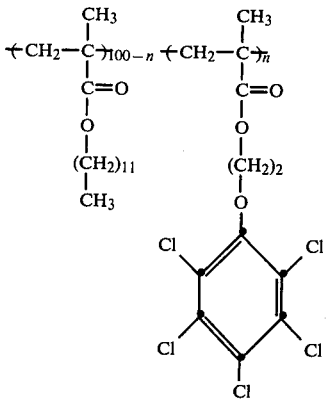

wherein n is about 70 to about 90 weight percent.

9. An electrically activatable recording element as in claim 6 wherein said polymer consists essentially of poly(tribromophenoxypropyl acrylate).

10. An electrically activatable recording element as in claims 1 or 6 wherein said polymeric electrically active conductive layer is about 0.02 to about 10 microns thick.

11. An electrically activatable recording element as in claim 6 wherein said 1,2-4-mercaptotriazole derivative is represented by the structure:

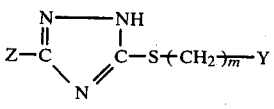

wherein Y is aryl containing 6 to 12 carbon atoms; m is 0, 1 or 2; and Z is hydrogen, hydroxyl or amine.

12. An electrically activatable recording element as in claims 1 or 6 comprising an electrically conductive support which is a poly(ethylene terephthalate) film having thereon, in sequence, a subbing layer and an electrically conductive cermet layer.

13. An electrically activatable recording element as in claim 6 wherein said electrically activatable recording layer comprises an electrically conductive binder consisting essentially of a poly(acrylamide).

14. In an electrically activatable recording element comprising a poly(ethylene terephthalate) film support having thereon a subbing layer comprising poly(methyl acrylate-co-vinylidene chloride-co-itaconic acid) and having on the subbing layer an electrically conductive cermet layer and having on said cermet layer, in sequence:

(a) a polymeric electrically active conductive layer;
(b) an electrically activatable recording layer comprising, in an electrically conductive polyacrylamide binder,
  (A) a dye-forming coupler consisting essentially of a compound selected from the group consisting of 2,6-dihydroxyacetanilide and 2′,6′-dihydroxytrifluoroacetanilide and combinations thereof, and
  (B) an oxidation-reduction combination consisting essentially of
    (i) an organic silver salt oxidizing agent consisting essentially of a silver salt of 3-amino-5-benzylthio-1,2,4-triazole, with
    (ii) a reducing agent consisting essentially of 4-amino-2-methoxy-N,N,5-trimethyl aniline sulfate,
(c) a photoconductive layer separated from (b) by an air gap of up to 20 microns or by an electrically conductive interlayer,
(d) an electrically conductive layer, the improvement wherein
  the polymeric electrically activated conductive layer consists essentially of poly(tribromophenoxypropyl acrylate).

15. In an electrically activatable recording element comprising an electrically conductive support having thereon, in sequence:

(a) a polymeric electrically active conductive layer,
(b) an electrically activatable recording layer comprising:
  (A) a dye-forming coupler, and
  (B) an oxidation-reduction combination comprising
    (i) an organic silver salt oxidizing agent consisting essentially of a silver salt of 1,2,4-mercaptotriazole derivative with
    (ii) a reducing agent which, in its oxidized form, forms a dye with said dye-forming coupler, the improvement wherein the polymeric electrically active conductive layer comprises a polymer that has recurring units represented by the structure:

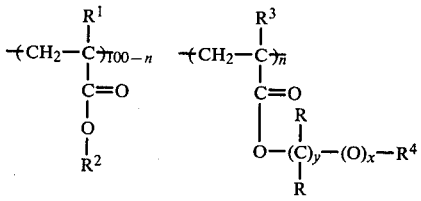

wherein

R is hydrogen or alkyl containing 1 to 20 carbon atoms;

$R^1$ and $R^3$ are individually hydrogen or methyl;

$R^2$ is alkyl containing 2 to 20 carbon atoms;

x is 0 or 1;

y is 0 to 4;

$R^4$ is $C_6H_{5-z}X_z$; wherein z is 1 to 5;

X is chlorine, bromine or iodine;

n is 40 to 100 weight percent;

said polymer having a glass transition temperature which is within the range of about 20° C. to about 40° C.

16. An electrically activatable recording element as in claim 15 wherein X is chlorine and z is 5.

17. An electrically activatable recording element as in claim 15 wherein said polymer has recurring units represented by the structure:

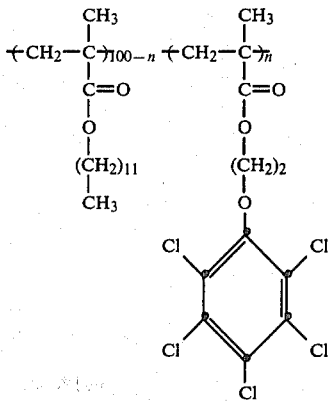

wherein n is about 70 to about 90 weight percent.

18. An electrically activatable recording element as in claim 15 wherein said polymer consists essentially of poly(tribromophenoxypropyl acrylate).

19. An electrically activatable recording element as in claim 15 wherein said polymeric electrically active conductive layer is about 0.02 to about 10 microns thick.

20. An electrically activatable recording element as in claim 15 wherein said mercaptotriazole derivative is represented by the structure:

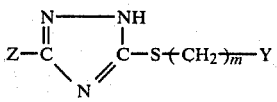

wherein Y is aryl containing 6 to 12 carbon atoms; m is 0, 1 or 2; and Z is hydrogen, hydroxyl or amine.

21. An electrically activatable recording layer as in claim 15 wherein said electrically activatable recording layer comprises an electrically conductive binder consisting essentially of a poly(acrylamide).

22. An electrically activatable recording element comprising a poly(ethylene terephthalate) film support having thereon a subbing layer comprising poly(methyl acrylate-co-vinylidene chloride-co-itaconic acid) and having on the subbing layer an electrically conductive cermet layer and having on the cermet layer, in sequence:

(a) a polymeric electrically active conductive layer, (b) an electrically activated recording layer comprising, in an electrically conductive poly(acrylamide) binder, (A) a dye-forming coupler consisting essentially of a compound selected from the group consisting of 2,6-dihydroxyacetanilide and 2',6'-dihydroxytrifluoroacetanilide and combinations thereof, and (B) an oxidation-reduction combination consisting essentially of (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethyl aniline sulfate, the improvement wherein the polymeric electrically active conductive layer consists essentially of a polymer having recurring units represented by the structure:

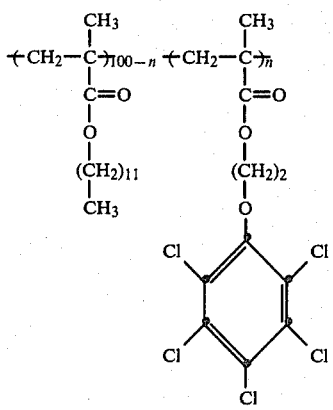

wherein n is about 70 to about 90 weight percent.

23. An electrically activatable recording element comprising a poly(ethylene terephthalate) film support having thereon a subbing layer comprising poly(methyl acrylate-co-vinylidene chloride-co-itaconic acid) and having on the subbing layer an electrically conductive cermet layer and having on the cermet layer, in sequence:

(a) a polymeric electrically active conductive layer, (b) an electrically activated recording layer comprising, in an electrically conductive poly(acrylamide) binder, (A) a dye-forming coupler consisting essentially of a compound selected from the group consisting of 2,6-dihydroxyacetanilide and 2',6'-dihydroxytrifluoroacetanilide and combinations thereof, and (B) an oxidation-reduction combination consisting essentially of (i) an organic solvent salt oxidizing agent consisting essentially of a silver salt of 3-amino-5-benzylthio-1,2,4-triazole, with (ii) a reducing agent consisting essentially of 4-amino-2-methoxy-N,N,5-trimethyl aniline sulfate, the improvement wherein the polymeric electrically active conductive layer consists essentially of a polymer consisting essentially of poly(tribromophenoxypropyl acrylate).

24. A dry, electrically activatable recording process for producing a dye-enhanced silver image in an electrically activatable recording element comprising an electrically conductive support having thereon, in sequence:

(a) a polymeric electrically active conductive layer comprising a polymer having recurring units represented by the structure:

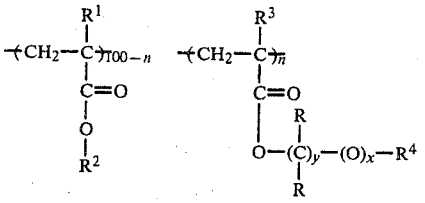

wherein

R is hydrogen or alkyl containing 1 to 20 carbon atoms;

$R^1$ and $R^3$ are individually hydrogen or methyl;

$R^2$ is alkyl containing 2 to 20 carbon atoms;

x is 0 or 1;

y is 0 to 4;

$R^4$ is $C_6H_{5-z}X_z$; wherein z is 1 to 5;

X is chlorine, bromine or iodine;

n is 20 to 100 weight percent;

said polymer having a glass transition temperature within the range of 20° C. to 40° C.;

(b) an electrically activatable recording layer comprising (A) a dye-forming coupler, and (B) an oxidation-reduction combination comprising:

(i) an organic silver salt oxidizing agent consisting essentially of a silver salt of a 1,2,4-mercaptotriazole derivative with (ii) a reducing agent which, in its oxidized form, forms a dye with said dye-forming coupler, said process comprising the steps of:

(I) imagewise applying to said recording element an electrical potential of a magnitude and for a time sufficient to produce in the image areas a charge density within the range of about $10^{-5}$ coulomb/cm$^2$ to about $10^{-8}$ coulomb/cm$^2$; and (II) heating said recording element substantially uniformly at a temperature and for a time sufficient to develop a dye-enhanced silver image in said recording layer.

25. A process as in claim 24 wherein X is chlorine and z is 5.

26. A process as in claim 24 wherein said polymer has recurring units represented by the structure:

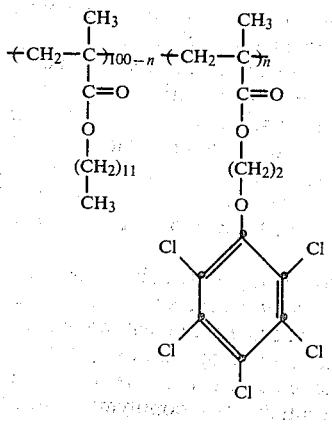

wherein n is about 70 to about 90 weight percent.

27. A process as in claim 24 wherein said polymer consists essentially of poly(tribromophenoxypropyl acrylate).

28. A dry, electrically activatable recording process for producing a dye-enhanced silver image in an electrically activatable recording element comprising, in sequence:

(a) an electrically conductive layer, (b) a photoconductive layer, (c) an electrically activatable recording layer separated from (b) by an air gap of up to 20 microns or by an electrically conductive interlayer, said electrically activatable recording layer comprising (A) a dye-forming coupler, and (B) an oxidation-reduction combination comprising:

(i) an organic silver salt oxidizing agent consisting essentially of a silver salt of a 1,2,4-mercaptotriazole derivative with (ii) a reducing agent which, in its oxidized form, forms a dye with said dye-forming coupler, (d) a polymeric electrically active conductive layer comprising a polymer that has recurring units represented by the structure:

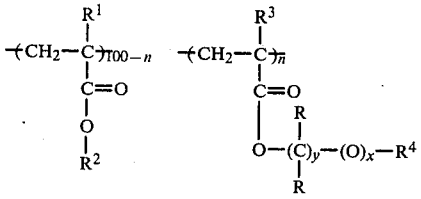

wherein

R is hydrogen or alkyl containing 1 to 20 carbon atoms;

$R^1$ and $R^3$ are individually hydrogen or methyl;

$R^2$ is alkyl containing 2 to 20 carbon atoms;

x is 0 or 1;

y is 0 to 4;

$R^4$ is $C_6H_{5-z}X_z$; wherein z is 1 to 5;

X is chlorine, bromine or iodine;

n is 40 to 100 weight percent;

said polymer having a glass transition temperature within the range of about 20° C. to about 40° C.; and, (e) an electrically conductive support;

said process comprising the steps of:

(I) imagewise altering the conductivity of said photoconductive layer in accord with an image to be recorded;

(II) applying across said photoconductive layer and said recording layer an electrical potential of a magnitude and for a time sufficient to produce a latent image in said recording layer corresponding to the image to be recorded; and, (III) substantially uniformly heating said recording layer for a time sufficient to produce a dye-enhanced silver image in said recording layer.

29. A process as in claim 28 wherein said recording layer is heated in step (III) to a temperature within the range of about 100° C. to about 180° C. until a dye-enhanced silver image is produced in said recording layer.

30. A dry, electrically activatable recording process for producing a dye-enhanced silver image in an electrically activatable recording element comprising, in sequence:

(a) a first support having thereon (b) a first electrically conductive layer, and (c) a photoconductive layer, having thereover (d) an electrically activatable recording layer separated from (c) by (i) an air gap of up to 20 microns or (ii) by an electrically conductive interlayer, said electrically activatable recording layer comprising, in an electrically conductive polyacrylamide binder, (A) a dye-forming coupler consisting essentially of a compound selected from the group consisting of 2,6-dihydroxyacetanilide and 2',6'-dihydroxytrifluoroacetanilide and combinations thereof, and (B) an oxidation-reduction combination comprising (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethyl aniline sulfate, (e) a polymeric electrically active conductive layer consisting essentially of poly(tribromophenoxypropyl acrylate), (f) an electrically conductive cermet layer, and (g) a second support;

said process comprising the steps of:

(I) imagewise altering the conductivity of said photoconductive layer in accord with an image to be recorded;

(II) applying an electrical potential across said photoconductive layer and recording layer of a magnitude and for a time sufficient to produce a latent image in said recording layer corresponding to said image to be recorded; and, (III) heating said recording layer substantially uniformly at a temperature and for a time sufficient to produce a dye-enhanced silver image in said recording layer.

31. A process as in claim 30 wherein said recording layer is heated in step (III) to a temperature within the range of about 100° C. to about 180° C. until a dye-enhanced silver image is produced in said recording layer.

32. A dry, electrically activatable recording process for producing a dye-enhanced silver image in an electrically activatable recording element comprising the steps of:

(I) imagewise altering the conductivity of a photoconductive layer in accord with an image to be recorded;

(II) positioning the imagewise altered photoconductive layer from (I) within 20 microns of an electrically activatable recording layer of said electrically activated recording element, or positioning the imagewise altered photoconductive layer from (I) on an electrically conductive interlayer contiguous to said electrically activated recording layer of said electrically activated recording element, said element comprising an electrically conductive support having thereon, in sequence:

(a) a polymeric electrically active conductive layer consisting essentially of a copolymer comprising recurring units represented by the structure:

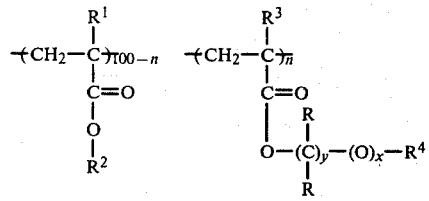

wherein

R is hydrogen or alkyl containing 1 to 20 carbon atoms;

$R^1$ and $R^3$ are individually hydrogen or methyl;

$R^2$ is alkyl containing 2 to 20 carbon atoms;

x is 0 or 1;

y is 0 to 4;

$R^4$ is $C_6H_{5-z}X_z$; wherein z is 1 to 5;

X is chlorine, bromine or iodine;

n is 40 to 100 weight percent;

said polymer having a glass transition temperature within the range of 20° C. to 40° C.; and (b) said electrically activatable recording layer comprising (A) a dye-forming coupler, and (B) an oxidation-reduction combination comprising (i) an organic silver salt oxidizing agent consisting essentially of a silver salt of a 1,2,4-mercaptotriazole derivative with (ii) a reducing agent which, in its oxidized form, forms a dye with said dye-forming coupler, (III) applying an electrical potential across said photoconductive layer and recording layer of a magnitude and for a sufficient time to produce in the areas of said recording layer corresponding to the imagewise altered portions of said photoconductive layer a charge density within the range of about $10^{-5}$ coulomb/cm$^2$ to about $10^{-8}$ coulomb/cm$^2$, said charge density forming in said areas a latent image; and, (IV) uniformly heating the recording element at a temperature and for a time sufficient to produce a dye-enhanced silver image in said recording element.

33. A dry, electrically activatable recording process as in claim 32 further comprising the steps:

(V) positioning said imagewise altered photoconductive layer within 20 microns adjacent a second electrically activated recording layer, or positioning said imagewise altered photoconductive layer on an electrically conductive interlayer contiguous to a second electrically activated recording layer;

(VI) applying an electrical potential across said photoconductive layer and said second recording layer of a magnitude and for a time sufficient to produce in the imagewise altered portions of said recording layer a charge density within the range of about $10^{-5}$ coulomb/cm$^2$ to about $10^{-8}$ coulomb/cm$^2$, said charge density forming a latent image; and, (VII) uniformly heating said second recording layer at a temperature and for a time sufficient to produce a developed image in said second recording layer.

34. A dry, electrically activatable recording process for producing a dye-enhanced silver image in an electrically activated recording element comprising on an electrically conductive support, in sequence:

(a) a polymeric electrically active conductive layer consisting essentially of a copolymer that comprises recurring units represented by the structure

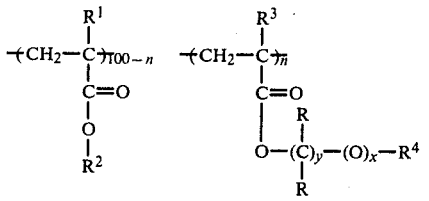

wherein

R is hydrogen or alkyl containing 1 to 20 carbon atoms;

$R^1$ and $R^3$ are individually hydrogen or methyl;

$R^2$ is alkyl containing 2 to 20 carbon atoms;

x is 0 or 1;

y is 0 to 4;

$R^4$ is $C_6H_{5-z}X_z$; wherein z is 1 to 5;

X is chlorine, bromine or iodine;

n is 40 to 100 weight percent;

said polymer having a glass transition temperature within the range of 20° C. to 40° C.; and (b) an electrically activatable recording layer comprising (A) a dye-forming coupler, and (B) an oxidation-reduction combination comprising (i) an organic silver salt oxidizing agent consisting essentially of a silver salt of a 1,2,4-mercaptotriazole derivative with (ii) a reducing agent which, in its oxidized form, forms a dye with said dye-forming coupler, said process comprising the steps of:

(I) positioning said recording element in face-to-face relationship with a photoconductive element wherein said recording element is separated from said photoconductive element by an air gap of up to 20 microns or separated from said photoconductive element by an electrically conductive interlayer;

(II) exposing said photoconductive element to an imagewise pattern of actinic radiation while simultaneously applying an electrical potential having a field strength of at least about $1\times10^3$ volts/centimeter across said photoconductive element and said recording element for a time sufficient to provide a latent image in the areas of said recording element corresponding to the exposed areas of said photoconductive element; and (III) substantially uniformly heating the recording element at a temperature and for a time sufficient to produce a dye-enhanced silver image in said recording element.

35. A process as in claim 34 wherein said recording element in step (III) is heated to a temperature within the range of about 100° C. to about 180° C. until a dye-enhanced silver image is produced.

36. A process as in claim 34 wherein said polymer has recurring units represented by the structure:

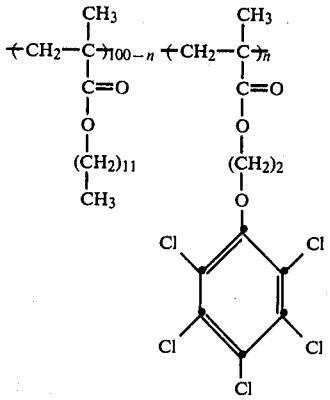

wherein n is about 70 to about 90 weight percent.

* * * * *